US006539658B1

(12) United States Patent
Hubert et al.

(10) Patent No.: US 6,539,658 B1
(45) Date of Patent: Apr. 1, 2003

(54) FIREARM EQUIPPED WITH RAPID SAFETY MECHANISM, DROP SAFETY AND SAFETY DEVICE KIT

(75) Inventors: Leon Hubert, Jupille-sur-Meuse; Robert Hubert, Herstal, both of (BE)

(73) Assignee: R.D.I.H. SPRL, Jupille (BE)

( * ) Notice: Subject to any disclaimer, the term of this patent is extended or adjusted under 35 U.S.C. 154(b) by 0 days.

(21) Appl. No.: 09/420,864

(22) Filed: Oct. 19, 1999

Related U.S. Application Data

(63) Continuation-in-part of application No. PCT/BE98/00069, filed on May 14, 1998.

(30) Foreign Application Priority Data

May 15, 1997 (BE) ..... 9700427
Oct. 19, 1998 (EP) ..... 98870216

(51) Int. Cl.[7] ..... F41A 17/00
(52) U.S. Cl. ..... 42/70.08; 89/142; 89/148; 89/150; 89/154; 89/27.12
(58) Field of Search ..... 42/70.07; 89/142, 89/148, 150, 154, 27.12

(56) References Cited

U.S. PATENT DOCUMENTS

| | | | | |
|---|---|---|---|---|
| 4,312,263 | A | 1/1982 | Bourlet | 89/154 |
| 4,461,110 | A | 7/1984 | Inderbitzen | 42/66 |
| 4,628,626 | A | 12/1986 | Brandt | 42/70.01 |
| 4,926,575 | A | 5/1990 | Pastor | 42/70.06 |
| 5,166,458 | A | 11/1992 | Yoo | 42/69.03 |
| 5,208,406 | A | 5/1993 | Badali | 42/70.08 |

FOREIGN PATENT DOCUMENTS

| | | |
|---|---|---|
| DE | 153 961 | 10/1904 |
| EP | 550 238 | 7/1993 |
| EP | 801 285 | 10/1997 |
| GB | 2 137 324 | 10/1984 |

OTHER PUBLICATIONS

International Search Report.

*Primary Examiner*—J. Woodrow Eldred
(74) *Attorney, Agent, or Firm*—Merchant & Gould P.C.

(57) ABSTRACT

A safety mechanism dedicated to a single-action type firearm, equipped with a firing system using a hammer, presented in a kit form, capable of factory assembly on the firearm, or adaptation to a firearm already in service, comprising:

Figure 1:
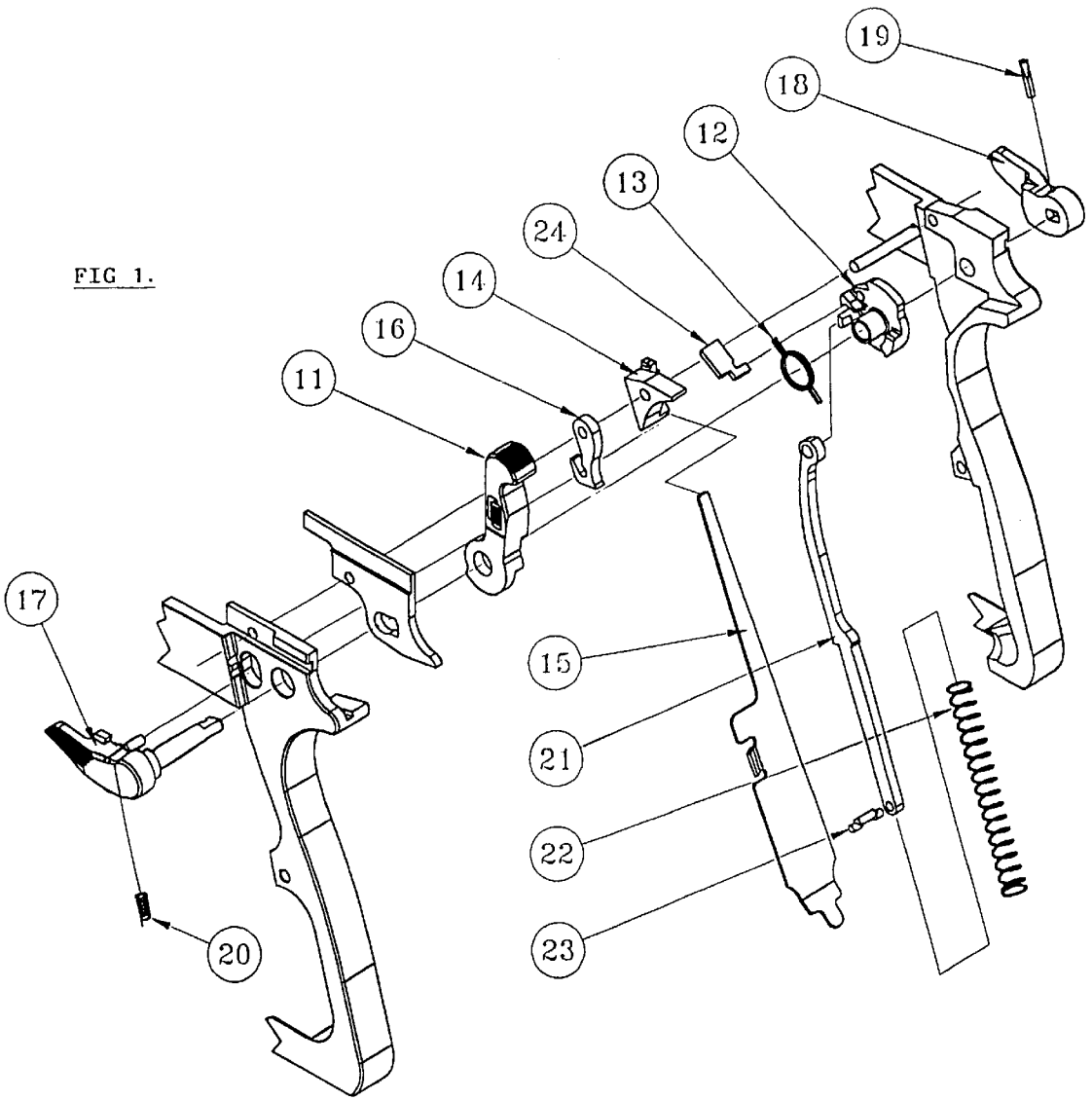

said hammer striking the firing pin of the firearm when firing;

a hammer ring working with the hammer;

a trigger-activated sear, which, during firing, releases the hammer ring;

a hammer strut including a hammer spring which is compressed to cock the hammer and which, when firing, propels the hammer ring, causing the hammer to strike the firing pin;

a cocking lever, which may be left/right, and which is activated manually to release the active safeties by releasing the sear, the hammer and the slide;

a return spring, to return the hammer backwards into the cocked position, ready to fire single action, a cocking lever spring;

a hammer spring, which is fixed thanks to a pin to the hammer strut;

a pin fastened to the cocking lever and a sear spring.

17 Claims, 7 Drawing Sheets

SLIDE
FIRING PIN
RDIH
18
24
14
16
17
12
11
122
B
I
C
171
112
121
111
X
A
J
D
G
F
E

FIREARM EQUIPPED WITH RAPID SAFETY MECHANISM, DROP SAFETY AND SAFETY DEVICE KIT

This application is a Continuation-In-Part of International application Serial No. PCT/BE98/00069, filed May 14, 1998, which application is incorporated herein by reference.

FIELD OF THE INVENTION

The present invention relates to a semiautomatic single-action type firearm, such as a pistol, equipped with a rapid safety mechanism and particularly a drop safety.

The present invention also relates to the safety device to be mounted on the firearm, proposed for sale in a kit form.

The present invention also relates to a right/left magazine stop.

STATE OF THE ART

Firearm safety devices which prevent the involuntary percussion of the hammer are well known. These safety devices are mainly of two types.

For single-action type firearms, the hammer may be locked in rear position. This nevertheless still involves risk if the weapon is dropped. The same system has further disadvantage of causing damage to the hammer and sear mechanism, leading to jamming, or accidental discharge, if the weapon is dropped.

Another safety mechanism for single-action type firearms is described in document U.S. Pat. No. 5,208,406. In this design, the upper part of the hammer alone is manually pivoted forwards into a safety position, which keeps the hammer from striking the firing pin. This is accomplished by exerting pressure on the hammer. But the hammer is not blocked or locked in this position, involving a persistent risk, for example, if the weapon is dropped.

In double-action firearms, the hammer safety position is the forward position. The first part of the trigger travel draws the hammer backwards, while the second part of the hammer travel permits firing by releasing the hammer, which travels forward, striking firing pin. In double-action weapons, the hammer travel is longer, and the time length required to fire a shot is therefore proportionally greater. It should also be noted that the force which must be exerted on the trigger is also particularly great. On the other hand, there is still some doubt, in the user's mind, as to the position of the hammer when he pulls the trigger. This type of firearm is described in document EP-A1-0 550 238.

In order to reduce the force exerted on the trigger to cock the hammer, a firearm has also been proposed, in document US-A-4 312 263, in which the trigger is locked by pushing the hammer forward. In this position, a safety ring also locks the slide. To unlock the pistol safety catch, the hammer must first be cocked by pulling the trigger (first action), then going on pulling the trigger to fire the weapon (second action).

Documents US-A-5 166 458 and EP-A2-0 801 285 likewise describe safety devices reducing the force to be exerted on the trigger to cock the firearm. In this case, the hammer contains a spring push button which clicks, without locking, into the cams on the hammer ring.

AIMS OF THE INVENTION

The present invention is aimed to supply a rapid safety device in a kit form, to be mounted on a semiautomatic type of firearm, such as a pistol, as well as the firearm itself, including said safety device, which would not present the disadvantages of the state of the art.

The present invention proposes, more particularly, to offer a safety device intended essentially for use on single-action firearms, thus permitting precise shooting without any need of changing the position of the trigger between the first and the following shots, while retaining the safety features of a double-action firearm.

An additional aim of the invention is to offer a safety device which, mounted on the firearm, would also reduce the risk of damage to the hammer and/or sear if the weapon is dropped.

Another aim of the present invention is to offer a device which, with a single movement, would prevent the weapon from firing, and which would also unlock the firearm, again, with a single movement, without pulling the trigger, in order to prepare the firearm for firing.

Additionally the invention further aims, in a single-action firearm, equipped with the aforementioned rapid safety device, when said firearm is in the safety position, to provide a component hindering physically the hammer—firing pin contact, which suppresses all percussion risk and reduces damage risk of functional parts, when the weapon is dropped.

A last aim of the present invention is to offer a safety device in a kit form, which would adapt relatively easily to a particular type of firearm while keeping the initial structure of an already in service firearm, without any need for additional machining of the concerned firearm, or of its component parts in order to assemble the kit.

SUMMARY OF THE INVENTION

A first object of the present invention relates to a semiautomatic single-action type of firearm equipped with a firing system using a hammer, like a pistol, or possibly, a revolver, which, by means of a trigger-activated sear, carries out the cartridge distribution, either in a slide, in the case of a pistol, or in a cylinder, in the case of a revolver, equipped with a mechanism to lock the hammer when the latter is in the forward position, thus safety-locking the firearm.

These locking means comprise at least one cocking lever which clicks in place automatically when the hammer is located in the forward position.

Preferably, the clicking of the cocking lever also locks the slide, which can no longer move backwards, and, possibly, the sear and/or trigger as well.

One particular advantage is that the locking method also releases the firearm safety catch by returning the hammer to the cocked position, and releasing the slide, sear, and/or the trigger, if necessary.

Another object of the present invention relates to a semiautomatic single-action type of firearm equipped with a firing mechanism using a hammer, such as a pistol, or, possibly, a revolver which, by means of a trigger-activated sear, distributes the cartridge, either in a slide, in the case of a pistol, or in a cylinder, in the case of a revolver, equipped with a device other than the trigger to unlock or release the hammer in the forward position, as well as the slide, sear, and/or trigger.

A third object of the present invention relates to a safety device in a kit form intended for a semiautomatic type of firearm equipped with a firing system using a hammer, such as a pistol, or possibly a revolver, to be mounted on the firearm in the factory, or adapted to an already in service firearm, characterized by in that it consists of a hammer which strikes the firing pin of the weapon during firing; a hammer ring co-operating with the hammer; a trigger-activated sear which, during firing, releases the hammer ring; a hammer strut containing the hammer spring, which is compressed in order to cock the hammer, and which, during firing, pushes the hammer ring, causing the hammer to strike the firing pin; a left and/or right cocking lever which is manually activated to release the active safeties by releasing the sear, the hammer, and the slide; a return spring to return the hammer to the backward cocked position, ready to fire single-action; and, possibly, a rapid-fire lever cooperating with the cocking lever, the hammer, and the hammer ring.

Advantageously, the safety device also comprises a cocking lever spring preferably fastening onto the cocking lever, either right or left; a hammer spring fastening onto a pin on the hammer strut; a pin fixed on the cocking lever, and a sear spring.

According to the invention, when the firearm is in the safety position with the hammer pulled forward, a component is further designed, which locates automatically between the slide and the hammer.

A final object of the present invention refers to a right/left magazine stop intended for a semiautomatic type of firearm equipped with a magazine stop travelling horizontally through the weapon, consisting of a button located at mid-level of the butt left side, in order to release the magazine by pushing the same button, preferably from left to right, and a small lever located at mid-level of the butt right side, in order to release the magazine by pushing the same lever, preferably downwards.

SHORT DESCRIPTION OF THE DRAWINGS

The present invention will be described with the assistance of the annexed figures representing several preferred embodiments of the invention, relating to different types of weapons, describing the assembly mechanisms of the various methods used in the corresponding safety devices, as well as their mechanism of action on the concerned firearms.

More particularly:

FIG. 1 is a cutaway view of the various parts forming the kit assembly, and consisting of the rapid safety device intended to be mounted on a HP pistol. The kit includes, in the HP embodiment, a hammer 11; a return spring 13; a sear 14; a so-called "fast shooting" lever 16; a left(right) cocking lever 17(18); a hammer strut 21 and a hammer ring 12. All these parts, except sear 14 and so-called "fast shooting" lever 16, are on the same axis in this particular embodiment. The kit further comprises the spring of the cocking lever 20, preferably fixed on the left(right) cocking lever 17(18); the hammer spring 22, fastened by means of a pin 23 of the hammer strut on the hammer strut 21, a pin 19 fixed on the right cocking lever 18 and a spring 15 in the sear, supported by the sear 14, as well as the drop safety 24, which will be described more in detail in FIGS. 6*a* to 6*c*.

Figure 2:
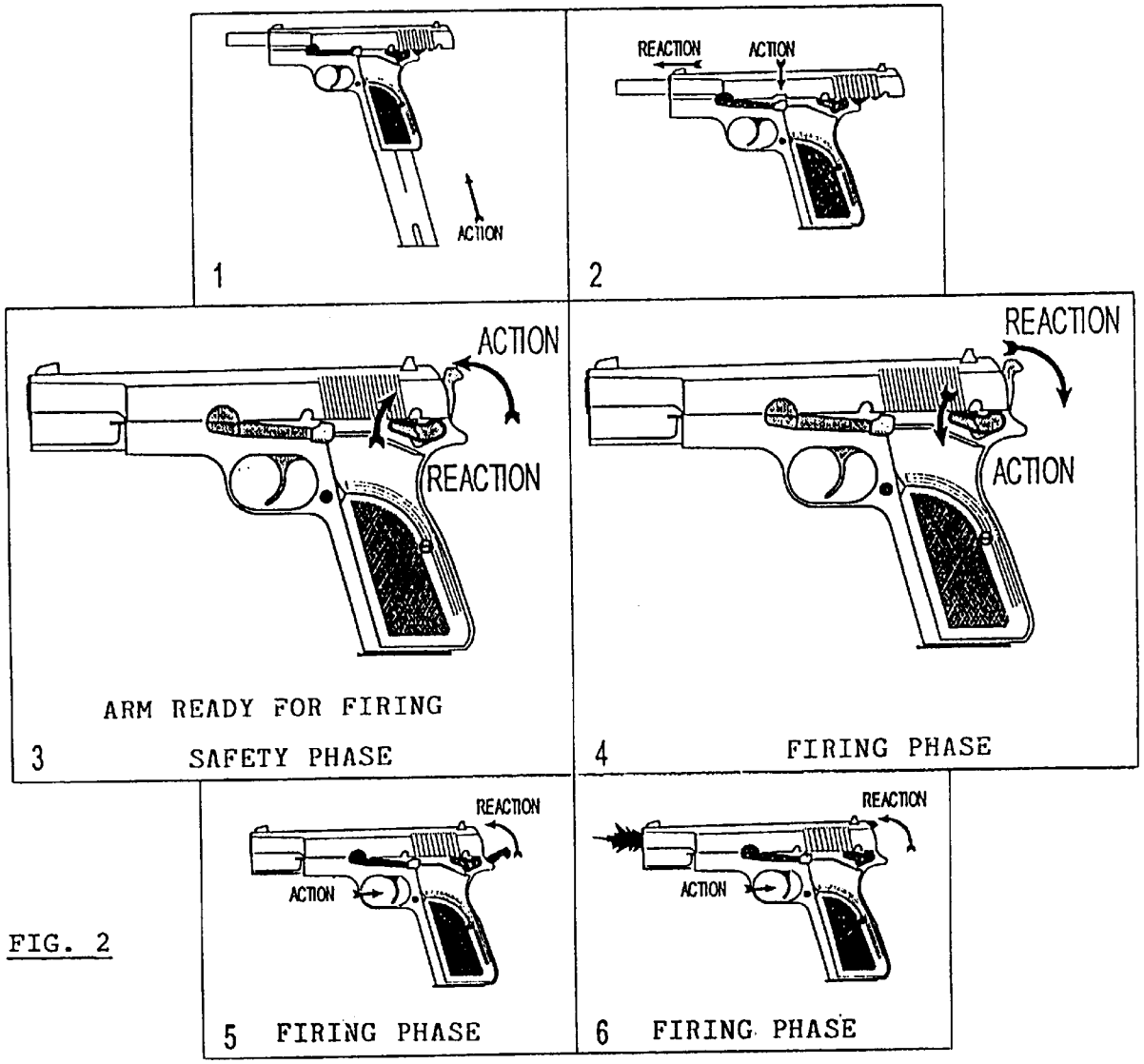

FIG. 2 is a summary description of the various positions of the firearm, equipped with a safety device according to the present invention, depending on the different actions of the shooter, thus in the different phases of cocking, firing and safety.

Figure 3A:
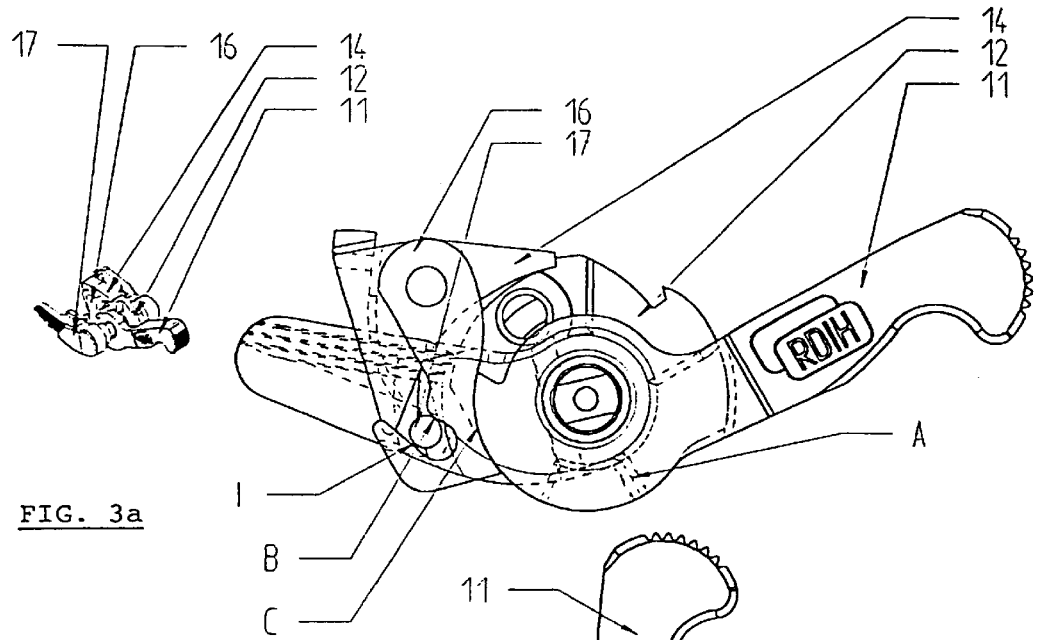
Figure 3B:
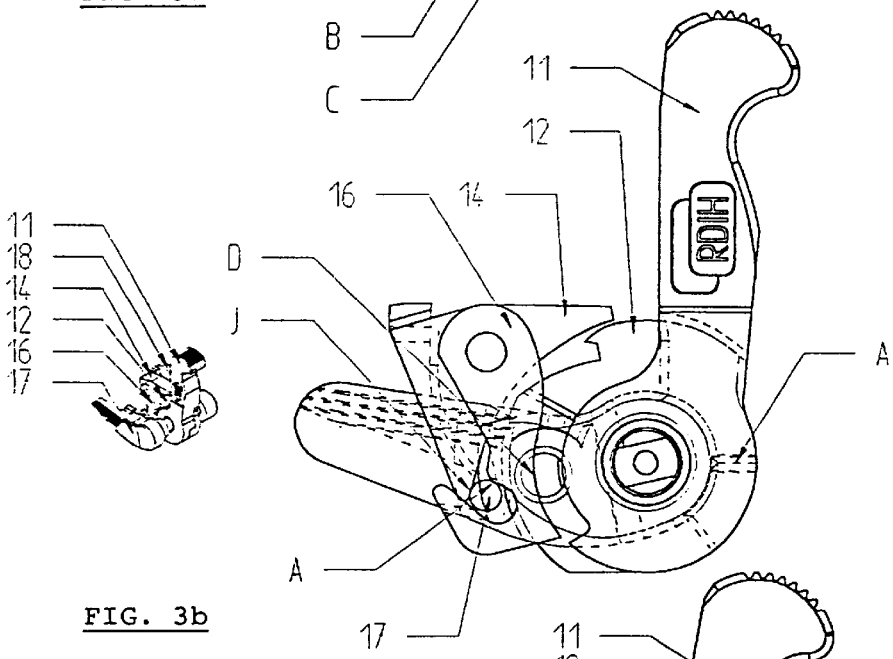
Figure 3C:
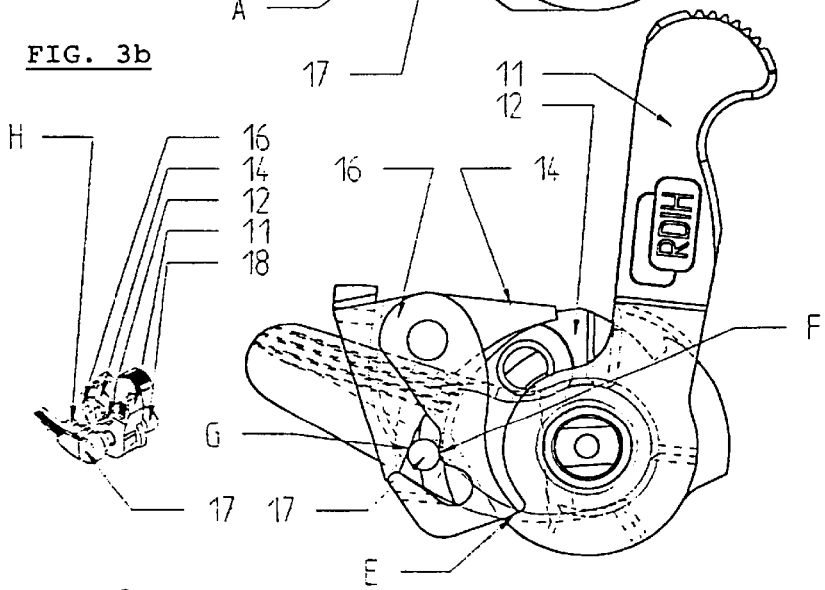

FIGS. 3*a* to 3*c* are cutaway views of the respective positions of the various moving parts in the single-action position (FIG. 3*a*), the firing position (FIG. 3*b*) and the safety position (FIG. 3*c*), in the case of a HP BROWNING-type firearm or derivative.

Figure 4A:
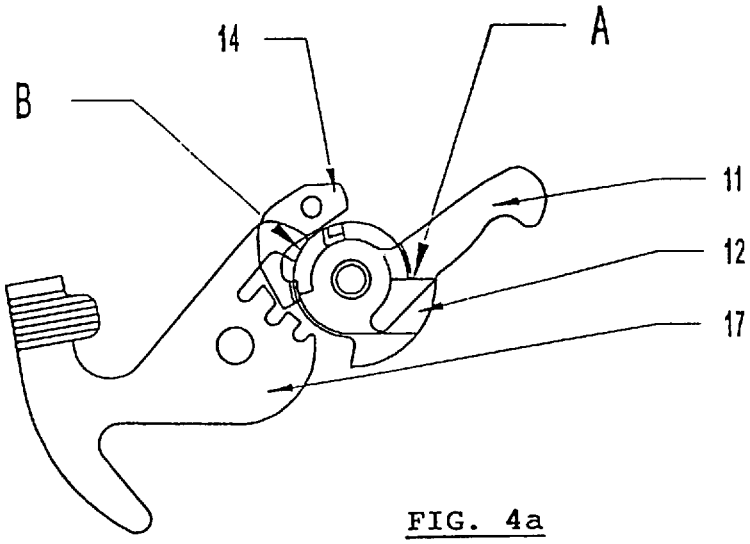
Figure 4B:
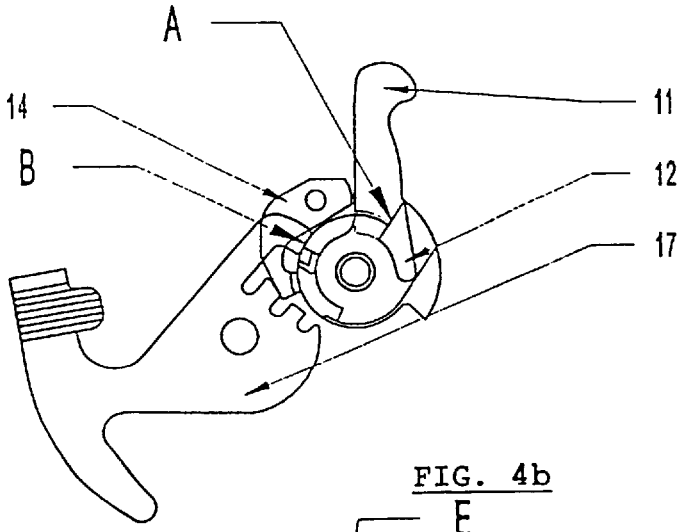
Figure 4C:
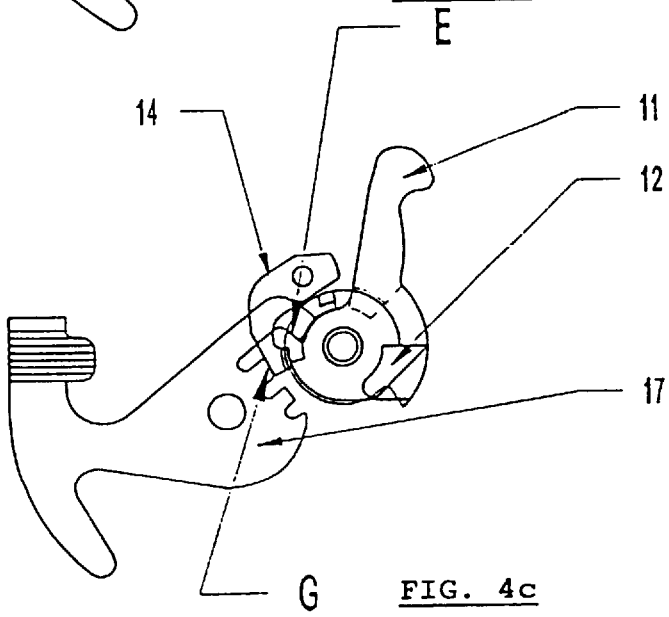

FIGS. 4*a* to 4*c* are cutaway views of the respective positions of the various moving parts in the single-action position (FIG. 4*a*), the firing position (FIG. 4*b*) and the safety position (FIG. 4*c*), in the case of a SIG-type series P220 firearm or derivative.

Figure 5A:
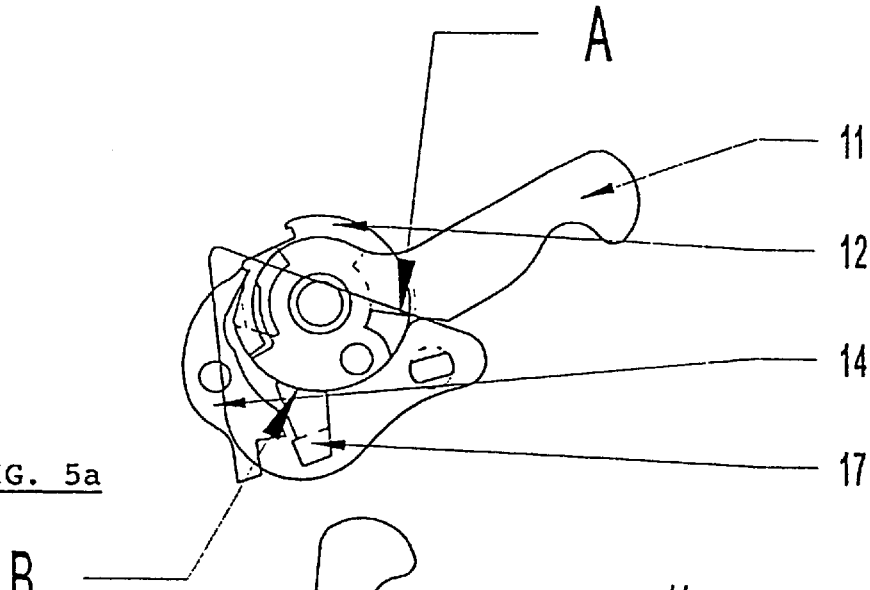
Figure 5B:
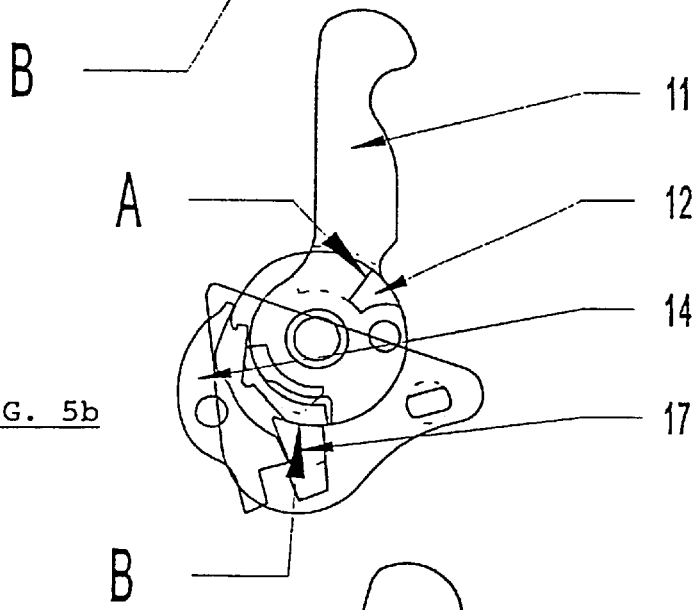
Figure 5C:
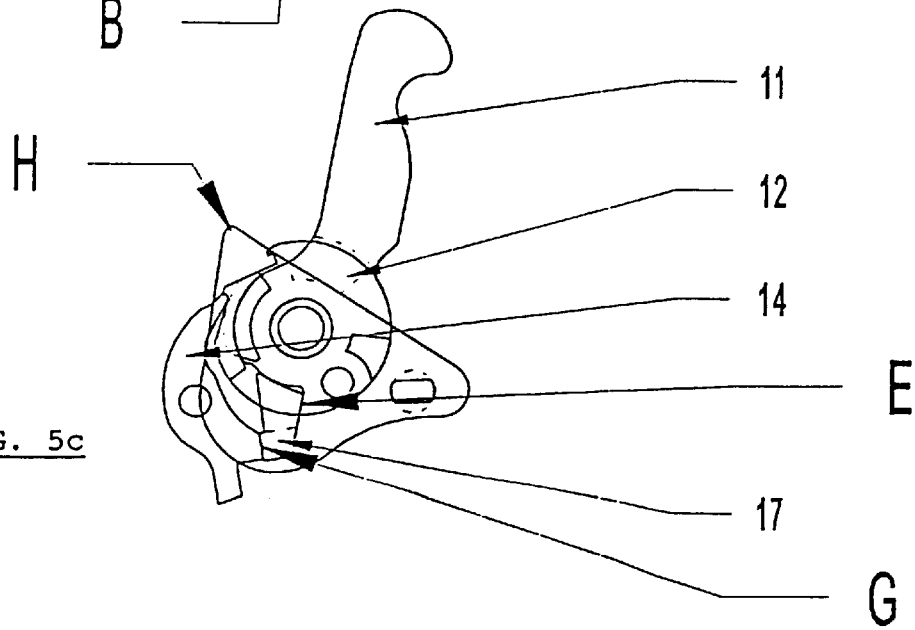

FIGS. 5*a* to 5*c* are cutaway views of the respective positions of the various moving parts in the single-action position (FIG. 5*a*), the firing position (FIG. 5*b*) and the safety position (FIG. 5*c*), in the case of a COLT 0.45-type firearm or derivative.

Figures 6A, 6B, 6C:
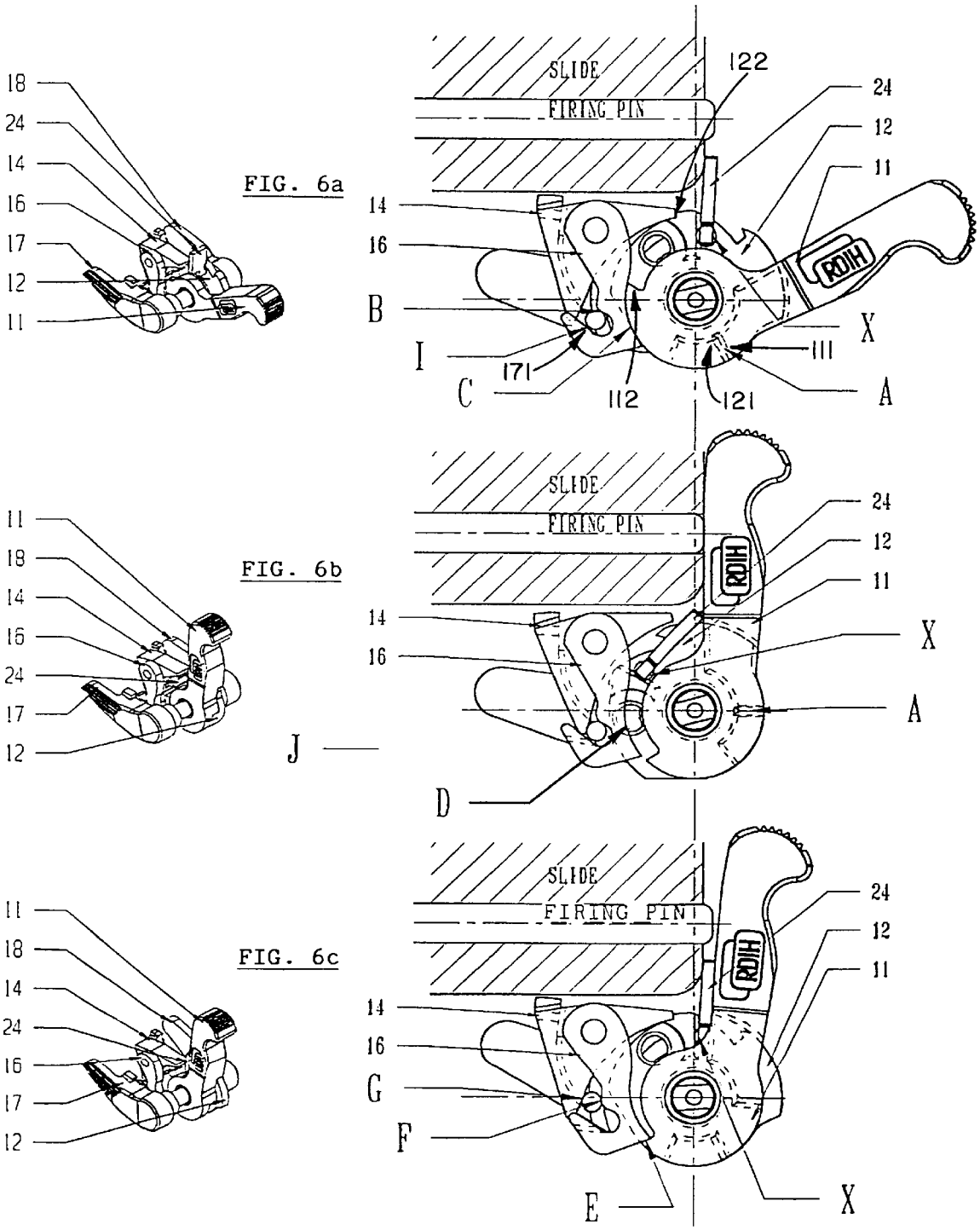

FIGS. 6*a* to 6*c* are similar to FIGS. 3*a* to 3*c,* but include the drop safety mechanism acting on the hammer of a pistol or revolver of any type and equipped with the rapid safety device. For illustrative purpose, this mechanism is presented here on a HP BROWNING-type firearm.

Figure 7:
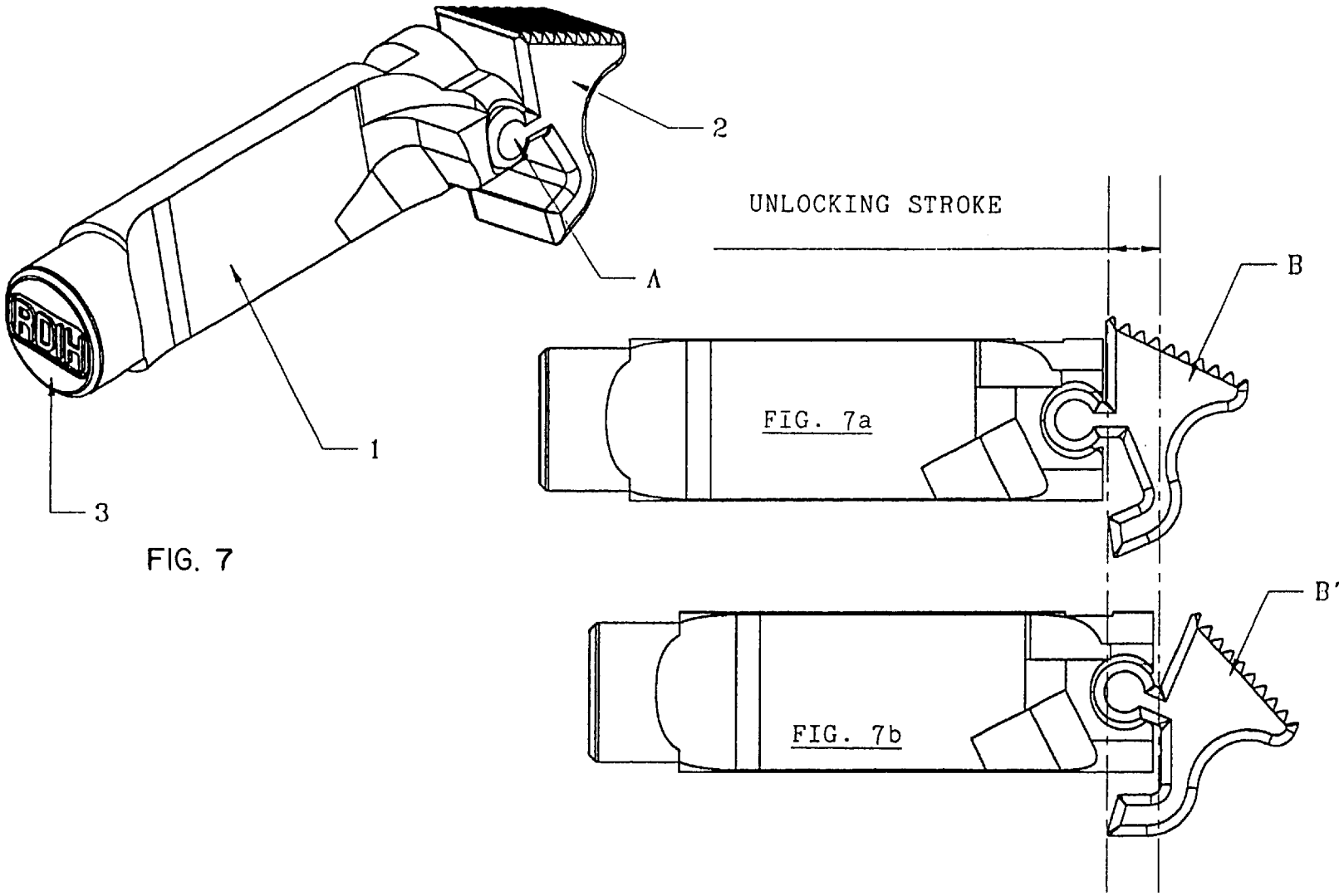

FIG. 7 is a perspective view of a right/left magazine stop.

FIGS. 7*a* and 7*b* show firearm loading operations (FIG. 7*a*) and magazine extraction operations (FIG. 7*b*) in the case of a firearm equipped with a right/left magazine stop according to the invention.

DESCRIPTION OF A PREFERRED EMBODIMENT OF THE INVENTION

The rapid safety device presented in a kit form, hereinafter referred to as rapid fire safety, may be mounted in the factory on a semiautomatic type of firearm such as a pistol, or may be adapted on a weapon already in service, based on a kit. In the latter case, the modification will be carried out very simply by any gunsmith with the aforementioned kit corresponding to the respective firearm, the rest of the weapon remaining identical to the original firearm.

The safety device, which is particularly simple, is adapted to any semiautomatic type of firearm without any modification of the firing characteristics of said firearm.

Several preferred embodiments of the present invention are described below for three particular semiautomatic weapons, the HP, the Colt 0.45, and the SIG series P220.

FIGS. 3 are cutaway views of the different parts composing the safety device according to the different phases, explaining the functioning of the weapon. In particular, FIGS. 3 relate to a HP pistol, with the following features:

1. Single Action (FIG. 3*a*)

In single action, the hammer 11 is kept in contact with the hammer ring 12 at A by the action of the return spring 13, this assembly being held back by the sear 14 in the cocked position (compressed hammer spring 22), while the sear itself is kept in position by the action of the sear spring 15.

The cocking lever 17 is pushed upwards by the action of the cocking lever spring 20, and kept on the level of its index at B by the SFS lever 16, locked against the hammer at C.

Since the weapon is ready to fire, the shooter has two options.

2. Firing (FIG. 3*b*)

This phase is identical in all firearms using the single action system. The shooter pulls the trigger, which, due to basic principle of the weapon, causes the sear 14 to pivot on its axis until it strikes, just after the release from a recess 122 of hammer ring 12, to release the hammer ring 12, which, due to the pressure exerted by the hammer spring 22, propels the hammer to A, which finishes its travel by violently striking the firing pin (discharge). During the aforementioned movements of the parts which cause the weapon to fire, the cocking lever 17 remains locked by the fast shooting lever 16 at A, which itself remains in the initial position due to its new contact at D with the hammer ring 12.

After firing, the hammer assembly 11 and hammer ring 12, impelled by the recoil of the moving parts (slide) return to the initial single action position (FIG. 3*a*).

3. Placing in Fast Shooting Position (FIG. 3*c*).

If the shooter decides not to use the weapon immediately, he must return the weapon to the safety position, hereinafter referred to as the SFS position, due its specificity. Hence, since the weapon is in the single action position (FIG. 3*a*), the shooter must first push the hammer 11, exerting pressure thereon, causing it to pivot from the rear position to the forward position, until it clicks into the fast shooting lever 16 at E, which in turn has been propelled by the control index of the cocking lever 17 at F, which is itself propelled upwards by the cocking lever spring 20. The same pressure exerted by the index of the cocking lever 17 also locks the sear 14 through its contact at G, and, as a result, the hammer is locked in the forward position. Since the cocking lever 17 is in the high position, the spur on the cocking lever also clicks into a notch on the slide at H, locking the slide.

4. Return to Single Action Position

When the shooter decides to use the weapon again, he must return th e weapon to the single action position.

Before or during target acquisition, the shooter, to release the safeties activated during placement in t he SFS position, exert s a downward pressure on the cocking lever 17 until it releases the SFS lever 16 due to its contact at I, thus releasing the safeties activated by the exit of the spur H of the cocking lever 17 from the slide, and by the release of the sear, thus causing the return spring 13 to return the hammer 11 to the rear position, ready to fire in single action (FIG. 3*a*)

FIG. 4 are cutaway views of the different parts making up the safety mechanism according to the different phases, and explaining the functioning of the weapon. In particular, FIG. 4 relate to a SIG series P220, in which the characteristics are as follows:

1. Single Action (FIG. 4*a*)

In single action, the hammer 11 is kept in contact with the hammer ring 12 at A by the action of the return spring 13, this assembly being held up by the sear 14 in the cocked position (compressed hammer spring 22) which itself is held in position by the action of the sear spring 15.

The cocking lever 17 is pushed upwards by the action of the cocking lever 20 and held against the hammer in B, which prevents it from returning to the upper position.

Since the weapon is ready to fire, two options are available to the shooter.

2. Firing (FIG. 4*b*)

This phase is identical in all weapons using the single action system, and is described here purely and simply for purposes of recall. The shooter pulls the trigger, which, due to the basic principle of the weapon, causes the sear 14 to pivot on its axis, releasing the hammer ring 12, which, due to the pressure exerted by the hammer spring 22, propels the hammer to A, which finishes its travel by violently striking the firing pin (percussion). During the above described movements of the parts causing the weapon to fire, the cocking lever 17 remains locked by the hammer 11 and the hammer ring 12 at B.

After firing, the assembly of the hammer 11 and hammer ring 12, propelled by the recoil of the moving parts (slide) return to the initial single action position (FIG. 4*a*).

3. Placement in the Fast Shooting Position (FIG. 4*c*)

If the shooter decides not use the weapon immediately, he must place the weapon in the safety position, hereinafter called SFS position, due to its specificity. Hence, since the weapon is in the single action position (FIG. 4*a*), he must push the hammer 11 by exerting pressure on it, causing it to pivot from the rear position to the forward position until the clicking of the index lever of the cocking lever 17 at E, which is pushed upwards by the cocking lever spring. This same movement of the cocking lever 17 also has the function of locking the sear 14 through its contact at G, the result of which is that the hammer is locked in the forward position, locking the sear 14. Since the hammer 11 acts as an obstacle to the slide, the latter cannot move backwards.

4. Return to the Single Action Position

When the shooter decides to use the weapon again, he must return the weapon to the single action position.

Before or during target acquisition, to release the safeties activated during placement in rapid fire safety position, the shooter must exert downward pressure on the cocking lever 17 until the clicking of the index of the cocking lever 17, which is going to release the active safeties by releasing the sear 14, as well as to cause the return spring 13 to return the hammer 11 to the rear position, ready to fire single action (FIG. 4*a*), with the passage of the released slide.

FIG. 5 are cutaway views of the different moving parts of the safety mechanism during the various phases, with an explanation of the functioning of the weapon. In particular, FIG. 5 relate to a COLT 0.45, in which the characteristics are as follows:

1. Single Action (FIG. 5*a*)

In single action, the hammer 11 is kept in contact with the hammer ring 12 at A by the direct action of the return spring 13. This assembly is held in the cocked position by the sear 14, with the hammer spring 22 compressed, while the sear itself is held in position by the action of the sear spring 15.

The cocking lever 17 is propelled upwards by the action of the cocking lever spring 20, and is held in position against the hammer in B, which prevents it from returning to the upper position.

Since the weapon is ready to fire, two options are open to the shooter.

2. Firing (FIG. 5*b*)

This phase is identical to all weapons using the single action principle, and is described here purely and simply for purposes of recall. The shooter pulls the trigger, which, due to the basic principle of the weapon, causes the sear 14 to pivot on its axis to release the hammer ring 12, which, due to the pressure exerted by the hammer spring 22, propels the hammer to A, which terminates its movement by violently striking the firing pin (percussion). During the movement of the parts causing the weapon to fire, the cocking lever 17 remains locked by the hammer 11 and the hammer ring 12 at B.

After firing, the hammer assembly 11 and hammer ring 12, propelled by the recoil of the moving parts (slide) returns to the initial single action position (FIG. 5*a*).

3. Placement in Fast Shooting Position (FIG. 5*c*)

If the shooter decides not to use the weapon immediately, he must return the weapon to the safety position, hereinafter referred to as the SFS position, due to its specificity. Hence, since the weapon is in single action position (FIG. 5*a*), he must push the hammer 11 by exerting pressure causing it to pivot from the rear position to the forward position, until the clicking of the index on the cocking lever 17 at E, which is pushed upwards by its spring. This same movement of the cocking lever 17 also has the function of locking the sear 14 through its contact at G, the result of which is that the hammer is locked in the forward position, with the sear 14 locked. Since the hammer cocking lever 17 is in the high position, the end of the cocking lever enters into the notch on the slide in H, and locks the slide.

4. Return to the Single Action Position

When the shooter decides to use the weapon again, he must return the weapon to the single action position.

Before or during target acquisition, to release the safeties activated during the placement in the SFS position, the shooter must exert downward pressure on the cocking lever 17 until the clicking of the index of the cocking lever 17, which is going to release the active safeties due to the exit of the end of the cocking lever from the slide, and due to the release of the sear 14, which also causes the rappel spring 13 to return the hammer 11 to the rear position, ready to fire single action (FIG. 5*a*).

FIG. 6 are cutaway views of the different parts composing the safety device, including drop safety, according to the different phases, explaining the functioning of the weapon. In particular, FIG. 6 relate to a HP pistol, with the following features:

1. Single Action (FIG. 6*a*)

In single action, the hammer 11 is kept in contact with the hammer ring 12 at A by the action of the return spring 13, this assembly being held back by the sear 14 in the cocked position (compressed hammer spring 22), while the sear itself is kept in position by the action of the sear spring 15. Hammer 11 has a tooth 111 and a recess 112. Hammer ring 12 is provided with a stop 121 for tooth 111 and a stop 122 for engaging a back portion of sear 14.

The cocking lever 17 is pushed upwards by the action of the cocking lever spring 20, and kept on the level of its index 171 at B by the SFS lever 16, locked against the hammer at C. The drop safety 24 pivots into the hammer ring 12 at X. The drop safety 24 stands then, either in down position, which is kept during firing, or maintained by its spring in up position, but will itself recover the down position, pushed by the slide rear during the hammer travel for firing.

Since the weapon is ready to fire, the shooter has two options.

2. Firing (FIG. 6*b*)

This phase is identical in all firearms using the single action system. The shooter pulls the trigger, which, due to basic principle of the weapon, causes the sear 14 to pivot on its axis until it strikes, just after the release from recess 112, to release the hammer ring 12, which, due to the pressure exerted by the hammer spring 22, propels the hammer to A, which finishes its travel by violently striking the firing pin (discharge). During the aforementioned movements of the parts which cause the weapon to fire, the cocking lever 17 remains locked by the fast shooting lever 16 at B, which itself remains in the initial position due to its new contact at D with the hammer ring 12. The drop safety 24 pivots into the hammer ring 12 at X in low position against the hammer 11, in order to go under the slide.

After firing, the hammer assembly 11 and hammer ring 12, impelled by the recoil of the moving parts (slide) return to the initial single action position (FIG. 6*a*) with the drop safety laying against the hammer 11.

3. Placing in Fast Shooting Position (FIG. 6*c*).

If the shooter decides not to use the weapon immediately, he must return the weapon to the safety position, hereinafter referred to as the SFS position, due its specificity. Hence, since the weapon is in the single-action position (FIG. 6*a*), the shooter must first push the hammer 11, exerting pressure thereon, causing it to pivot from the rear position to the forward position, until recess 112 of hammer 11 clicks into the fast shooting lever 16 at E, which in turn has been propelled by the control index 171 of the cocking lever 17 at F, which is itself propelled upwards by the cocking lever spring 20. The same pressure exerted by the index 171 of the cocking lever 17 also locks the sear 14 through its contact at G, and, as a result, the hammer is locked in the forward position. When pivoting forward, the hammer 11 lets the drop safety 24 pivot in the forward position into the hammer ring 12 at X. The drop safety 24 locates then between the hammer 11 and the slide rear, with suppression of any possible hammer—firing pin contact.

4. Return to Single Action Position

When the shooter decides to use the weapon again, he must return the weapon to the single action position.

Before or during target acquisition, the shooter, to release the safeties activated during placement in the SFS position, exerts a downward pressure on the cocking lever 17 until it releases the SFS lever 16 due to its contact at I, thus releasing the safeties activated by the exit of the spur H of the cocking lever 17 from the slide, and by the release of the sear, thus causing the return spring 13 to return the hammer 11 to the rear position, ready to fire in single action (FIG. 6*a*).

One achieves therefore a simple-action type firearm equipped with the aforementioned rapid safety device supplemented with a drop safety.

Component 24 which is used as a drop safety pivots into the hammer ring 12 and has, during firing (FIG. 6*b*) a position enabling it to go under the slide, while permitting firing.

In the safety position (FIG. 6*c*), component 24 locates between the slide rear part and the hammer front, preventing the latter from touching the firing pin, which prohibits firing.

Component 24 can click into both positions thanks to the hammer return spring or alternatively to an own spring.

Drop safety, in addition to all advantages linked to the rapid safety device, enables to suppress any firing pin—hammer contact in the so-called SFS position. This leads to minimize risks of percussion as well as component damage, when the weapon is dropped onto its rear side.

Since the system is universal in this type of weapon, it is quite obvious that the specific embodiments related to the HP (9 mm FN35), the SIG series P220, the COLT 0.45, and their derivatives, are only described for purpose of illustration and example, and that any other firearm equipped with a system of firing by means of a hammer could have been used in the same manner.

To do so, the principle of the invention must simply be adapted, as regards the design, to the specificity of the weapon in question, while retaining the same working principles, in order to benefit from all or part of the advantages set forth in the description of the mechanism of the invention.

In addition, the mechanism of the invention, including the drop safety, may be realized in a kit form, for assembly on an existing weapon, or it may form part of a new weapon leaving the assembly line.

The advantages of the product include the following:

- rapidity of fire (the weapon is ready at any time, and is carried with a cartridge in the chamber on full safety);
- manual cocking;
- the trigger is always in the same position;
- the trigger displacement is identical to that of single action firing;
- the trigger pull is identical to that of single action firing;
- all three safeties are activated and released in one single operation;
- the hammer is not activated if the weapon is dropped backwards, eliminating the risk of damage to the axes of the hammer and sear or their respective fastenings, and reduced risk of jamming;
- existing weapons can be modified very easily, using the mechanism of the invention, by any gunsmith, or by the police or military personnel, who are therefore enabled rapidly to modernize handguns already in their possession, at reduced cost.

A second objective of the present invention is to propose a left/right magazine stop, the principle of which is universal, and which, though described for a HP pistol (9 mm FN 35), is equally valid for any pistol equipped with a magazine stop travelling horizontally through the weapon. In this case, the assembly is easily adapted to the specificity of the weapon in question by any gunsmith, while retaining the same working principles in order to benefit from all or part of the advantages set forth in the product description.

According to the second objective of the present invention, the right/left magazine stop also may be produced in a kit form, to be mounted on an existing weapon, or it may be mounted on a new weapon leaving the assembly line.

FIG. 7 describes such a right/left magazine stop, and, in particular, the loading and extraction of the magazine.

1. Loading the Weapon

Insert a magazine in the weapon in the manner specified in the original instruction manual of the weapon in question.

2. Magazine Extraction

For a right-handed person, the right/left magazine stop 1 imposes no additional constraints upon the shooter, is handled in exactly the same manner and has the same mechanical characteristics as the original magazine stop. Pressure is exerted by the thumb of the right hand, from left to right, on the button 3, located at mid-level of the butt left side, releasing the magazine.

For a left-handed person, pressure is exerted by the thumb of the left hand, downwards, on the small lever 2 located at mid-level of the butt right side, releasing the magazine.

This lever, supported on the outside of the body from B to B', causes the stop 1 to move from left to right, due to the clicking of its fastening, which pivots inside the body of the stop at A.

What is claimed is:

1. A safety mechanism dedicated to a single-action type firearm, equipped with a firing system using a hammer, comprising:

said hammer striking a firing pin of the firearm when firing, said hammer having a tooth;

a hammer ring mounted with the hammer, said hammer ring having a stop that engages the hammer tooth;

a trigger-activated sear, which, during firing, releases the hammer ring;

a hammer strut including a hammer spring which is compressed to cock the hammer and which, when firing, propels the hammer ring, causing the hammer to strike the firing pin;

safeties that control movement of the hammer, the sear, and a slide of the firearm that supports the firing pin;

a right cocking lever and a left cocking lever, the left cocking lever being activated manually to release the safeties by releasing the sear, the hammer and the slide;

a return spring, to return the hammer backwards into a cocked position, ready to fire single action, a cocking lever spring that exerts upward force on the left cocking lever;

a hammer spring, which is fixed by a pin to the hammer strut;

a pin fastened to the right cocking lever to secure the right cocking lever to an axle of the mechanism; and a sear spring that holds the sear in position relative to the hammer.

2. A safety mechanism according to claim 1, wherein said firearm comprises a fast shooting lever, which can release the slide, the hammer and the hammer ring from a fast shooting position after the left cocking lever releases the fast shooting lever.

3. A semiautomatic type single-action firearm such as a pistol equipped with a firing system using a hammer, capable of striking the firing pin and which, by means of a trigger-activated sear, distributes the cartridge in a slide, in the case of a pistol, and which comprises a safety mechanism according to claim 1.

4. A firearm according to claim 3, wherein the left cocking lever is also used to release the firearm safety, by causing the hammer to return to the cocked position, and by releasing the slide, the sear and the trigger.

5. A safety mechanism according to claim 1, wherein a drop safety is provided, which pivots in the hammer ring, which, in a firing position, does not hinder access of the hammer to the firing pin in order to enable firing, and which, when the hammer is in a safety position, interposes between the hammer and the slide, in order to prevent any contact between the firing pin and the hammer, and thus to prohibit percussion.

6. A safety mechanism according to claim 5, wherein the drop safety pivots in the hammer ring and adopts, during firing, a position enabling it to go under the slide, thus permitting firing.

7. A safety mechanism according to claim 6, wherein, in the safety position, said drop safety is placed between the slide rear part and the hammer front side, preventing the latter from touching the firing pin, thus prohibiting firing.

8. A safety mechanism according to claim 7 wherein said drop safety is operable in two positions, one position in the hammer ring, and another position out of the hammer ring.

9. A semiautomatic type single-action firearm such as a pistol equipped with a firing system using a hammer, capable of striking the firing pin and which, by means of a trigger-activated sear, distributes the cartridge in a slide, in the case of a pistol, and which comprises a safety mechanism according to claim 5 and which can be incorporated in a firearm.

10. A Safety mechanism for a single-action type firearm, carrying a moving slide and equipped with a firing device comprising a hammer striking a firing pin during firing, said hammer being controlled by a trigger-activated sear that pivotally releases the hammer during firing and is subjected to a sear spring and mounted on a first axis, said sear cooperating with a hammer ring by use of a contact between a stop located on the hammer ring and a tooth located on the hammer, said hammer being subjected to the action of a return spring that tends to return the hammer to a single-action cocked position, said hammer being connected to a hammer strut that includes a spring intended to be tightened for cocking the hammer, wherein said mechanism further comprises means for simultaneously engaging three separate safeties on the hammer, the sear and the slide respectively, when said hammer is pushed forwards in a non-firing position from said cocked position.

11. The safety mechanism according to claim 10, wherein said means enable the three safeties to be simultaneously released, when said hammer is in said single-action cocked position.

12. A safety mechanism for a single-action type firearm, carrying a moving slide and equipped with a firing device comprising a hammer striking a firing pin during firing, said hammer being controlled by a trigger-activated sear that pivotally releases the hammer during firing and that is subjected to a sear spring and mounted on a first axis, said sear cooperating with a hammer ring by use of a contact between a stop located on the hammer ring and a tooth located on the hammer, said hammer being subjected to the action of a return spring tending to return the hammer to a single-action cocked position, said hammer being connected to a hammer strut that includes a spring intended to be tightened for cocking the hammer, wherein said firing device further comprises a cocking lever mounted on said first axis, said cocking lever provided with a finger and being subjected to a spring that tends to pivotally push the cocking lever upwards, and a fast shooting lever mounted on a second axis with said sear and having a back portion engaging a recess of the hammer in a locked position so the hammer is in a hammer safety position, wherein when said hammer is pushed manually forwards in said safety position, said first shooting lever simultaneously pivots with the cocking lever by means of a contact at said finger, said finger also locking the sear in a sear safety position.

13. The safety mechanism according to claim 12, wherein said cocking lever is provided with a spur that engages a notch provided in a side of said hammer when the hammer is pushed manually forwards in said hammer safety position, said spur and said hammer locking together so said slide is in a slide safety position when the cocking lever is in a cocking lever high position.

14. The safety mechanism according to claim 12, wherein a downward pressure manually exerted on said cocking lever enables the three safeties to be simultaneously released, as said hammer returns to a single-action cocked position.

15. The safety mechanism according to claim 1, wherein said mechanism is provided in a kit that is added to a firearm after factory assembly.

16. The safety mechanism according to claim 3, wherein said firearm is a revolver and the trigger-activated sear distributes the cartridge in a cylinder of the revolver.

17. The safety mechanism according the claim 9, wherein said firearm is a revolver and the trigger activated sear distributes the cartridge in a cylinder of the revolver.

* * * * *